US009324332B2

(12) United States Patent
Doehla et al.

(10) Patent No.: US 9,324,332 B2
(45) Date of Patent: Apr. 26, 2016

(54) METHOD AND ENCODER AND DECODER FOR SAMPLE-ACCURATE REPRESENTATION OF AN AUDIO SIGNAL

(71) Applicants: Stefan Doehla, Erlangen (DE); Ralph Sperschneider, Ebermannstadt (DE)

(72) Inventors: Stefan Doehla, Erlangen (DE); Ralph Sperschneider, Ebermannstadt (DE)

(73) Assignee: FRAUNHOFER-GESELLSCHAFT ZUR FOERDERUNG DER ANGEWAN, Muncih (DE)

( * ) Notice: Subject to any disclaimer, the term of this patent is extended or adjusted under 35 U.S.C. 154(b) by 500 days.

(21) Appl. No.: 13/649,298

(22) Filed: Oct. 11, 2012

(65) Prior Publication Data

US 2013/0041672 A1 Feb. 14, 2013

Related U.S. Application Data

(63) Continuation of application No. PCT/EP2011/055728, filed on Apr. 12, 2011.

(60) Provisional application No. 61/323,440, filed on Apr. 13, 2010.

(51) Int. Cl.

| | |
|---|---|
| ***G10L 19/00*** | (2013.01) |
| ***G10L 21/00*** | (2013.01) |
| ***G10L 19/16*** | (2013.01) |

(52) U.S. Cl.

CPC ..... *G10L 19/167* (2013.01)

(58) Field of Classification Search

CPC . G10L 19/008; G10L 19/0204; G10L 19/167; G10L 19/00; G10L 19/02; G10L 19/0017; G10L 19/20; G10L 19/005; G10L 19/025; G10L 19/12; H04S 3/008

USPC ..... 704/500–504

See application file for complete search history.

(56) References Cited

U.S. PATENT DOCUMENTS 6,954,893 B2 * 10/2005 Ternullo et al. ..... 714/807
7,043,677 B1 * 5/2006 Li ..... 714/758

(Continued)

FOREIGN PATENT DOCUMENTS

CN 101611600 A 12/2009
EP 0 758 123 A2 2/1997

(Continued)

OTHER PUBLICATIONS

"Information technology—Coding of audio-visual objects Part 3: Audio", International Standard, ISO/IEC 14496-3, 2009, 1413 pages (Continued)

*Primary Examiner* — Edgar Guerra-Erazo
(74) *Attorney, Agent, or Firm* — Keating & Bennett, LLP

(57) ABSTRACT

A method for providing information on the validity of encoded audio data is disclosed, the encoded audio data being a series of coded audio data units. Each coded audio data unit can include information on the valid audio data. The method includes: providing either information on a coded audio data level which describes the amount of data at the beginning of an audio data unit being invalid, or providing information on a coded audio data level which describes the amount of data at the end of an audio data unit being invalid, or providing information on a coded audio data level which describes both the amount of data at the beginning and the end of an audio data unit being invalid. A method for receiving encoded data including information on the validity of data and providing decoded output data is also disclosed. Furthermore, a corresponding encoder and a corresponding decoder are disclosed.

19 Claims, 9 Drawing Sheets

(56) References Cited

U.S. PATENT DOCUMENTS

| | | | | |
|---|---|---|---|---|
| 7,516,230 | B2 * | 4/2009 | Sperschneider et al. | 709/231 |
| 7,712,015 | B1 * | 5/2010 | Li | 714/807 |
| 7,778,839 | B2 * | 8/2010 | Metz | 704/500 |
| 7,941,235 | B2 | 5/2011 | Yoneda et al. | |
| 8,041,578 | B2 * | 10/2011 | Schnell et al. | 704/501 |
| 8,060,637 | B2 | 11/2011 | Kayanuma et al. | |
| 8,102,847 | B2 * | 1/2012 | Koide | 370/390 |
| 8,126,721 | B2 * | 2/2012 | Schnell et al. | 704/501 |
| 8,204,740 | B2 * | 6/2012 | Bruhn | 704/201 |
| 8,296,159 | B2 * | 10/2012 | Neuendorf | G10L 19/0208 704/200 |
| 8,417,532 | B2 * | 4/2013 | Schnell et al. | 704/501 |
| 8,538,565 | B2 | 9/2013 | Kawakami et al. | |
| 8,682,461 | B2 * | 3/2014 | Nakayama | 700/94 |
| 8,731,948 | B2 * | 5/2014 | Nagel et al. | 704/500 |
| 2005/0111493 | A1 * | 5/2005 | Han et al. | 370/509 |
| 2008/0027715 | A1 | 1/2008 | Rajendran et al. | |
| 2008/0065393 | A1 | 3/2008 | Kincaid | |
| 2008/0120116 | A1 * | 5/2008 | Schnell | G10L 19/025 704/500 |
| 2008/0270143 | A1 * | 10/2008 | Metz | 704/500 |
| 2009/0245251 | A1 * | 10/2009 | Koide | 370/390 |
| 2009/0319283 | A1 * | 12/2009 | Schnell | G10L 19/0204 704/503 |
| 2010/0061466 | A1 * | 3/2010 | Gozen et al. | 375/240.28 |
| 2011/0046965 | A1 * | 2/2011 | Taleb | G10L 19/025 704/501 |
| 2011/0173006 | A1 * | 7/2011 | Nagel et al. | 704/500 |
| 2011/0202358 | A1 * | 8/2011 | Neuendorf | G10L 19/0208 704/503 |
| 2014/0222434 | A1 * | 8/2014 | Nagel et al. | 704/268 |

FOREIGN PATENT DOCUMENTS

| | | | |
|---|---|---|---|
| EP | 0 770 990 | A2 | 5/1997 |
| EP | 1386311 | | 2/2004 |
| JP | 09-261070 | A | 10/1997 |
| JP | 2002-099299 | A | 4/2002 |
| JP | 2002-101395 | A | 4/2002 |
| JP | 2008-020863 | A | 1/2008 |
| JP | 2008-165656 | A | 7/2008 |
| JP | 2010-123225 | A | 6/2010 |
| JP | 2011-209412 | A | 10/2011 |
| RU | 2 183 034 | C2 | 5/2002 |
| RU | 2 233 010 | C2 | 7/2004 |
| WO | 02/089116 | A1 | 11/2002 |
| WO | 2006/107833 | A1 | 10/2006 |
| WO | 2008100477 | A1 | 8/2008 |
| WO | 2009/104402 | A1 | 8/2009 |
| WO | 2009/116141 | A1 | 9/2009 |

OTHER PUBLICATIONS

"Information technology—Coding of audio-visual objects Part 12: ISO base media file format", International Standarad, ISO/IEC 14496-12, 2008, 117 pages.

"Information technology—Coding of audio-visual objects Part 24: Audio and systems interaction", ISO/IEC JTC 1 N8529, 2007, 16 pages.

Bouvigne, "Mp3 Info Tag rev 1 specifications-draft 0", Jun. 3, 2009. Retrieved from the Internet: URL: http://gabriel.mp3-tech.org/mp3infotag.html.

Official Communication issued in International Patent Application No. PCT/EP2011/055728, mailed on Jun. 30, 2011.

Official Communication issued in International Patent Application No. PCT/EP2011/055728, mailed on May 31, 2012.

Official Communication issued in corresponding Japanese Patent Application No. 2013-504246, mailed on Jan. 7, 2014.

Official Communication issued in corresponding Russian Patent Application No. 2012148132/08, mailed on Nov. 25, 2014.

Official Communication issued in corresponding Chinese Patent Application No. 2011800292254, mailed on Mar. 17, 2015.

* cited by examiner

METHOD AND ENCODER AND DECODER FOR SAMPLE-ACCURATE REPRESENTATION OF AN AUDIO SIGNAL

CROSS-REFERENCE TO RELATED APPLICATIONS

This application is a continuation of copending International Application No. PCT/EP2011/055728, filed Apr. 12, 2011, which is incorporated herein by reference in its entirety, and additionally claims priority from U.S. Application No. 61/323,440, filed Apr. 13, 2010, which is also incorporated herein by reference in its entirety.

Embodiments of the invention relate to the field of source coding of an audio signal. More specifically, embodiments of the invention relate to a method for encoding information on the original valid audio data and an associated decoder. More specifically, embodiments of the invention provide the recovery of the audio data with their original duration.

BACKGROUND OF THE INVENTION

Audio encoders are typically used to compress an audio signal for transmission or storage. Depending on the coder used, the signal can be encoded lossless (allowing perfect reconstruction) or lossy (for imperfect but sufficient reconstruction). The associated decoder inverts the encoding operation and creates the perfect or imperfect audio signal. When literature mentions artifacts, then typically the loss of information is meant, which is typical for lossy coding. These include a limited audio bandwidth, echo and ringing artifacts and other information, which may be audible or masked due to the properties of human hearing.

SUMMARY

According to an embodiment, a method for providing information on the validity of encoded audio data so that invalid data caused by an encoder delay or data padding can be trimmed, the encoded audio data being a series of frames, wherein each frame can include information on the valid audio data, may have the steps of: providing either information on a frame level which describes the amount of data at the beginning of the frame being invalid, or providing information on the frame level which describes the amount of data at the end of the frame being invalid, or providing information on the frame level which describes both the amount of data at the beginning and the end of the frame being invalid.

Another embodiment may have an encoder for providing the information on the validity of data: wherein the encoder is configured to apply the method for providing information on the validity of encoded audio data so that invalid data caused by an encoder delay or data padding can be trimmed, the encoded audio data being a series of frames, wherein each frame can include information on the valid audio data, which method may have the steps of: providing either information on a frame level which describes the amount of data at the beginning of the frame being invalid, or providing information on the frame level which describes the amount of data at the end of the frame being invalid, or providing information on the frame level which describes both the amount of data at the beginning and the end of the frame being invalid.

According to another embodiment, a method for receiving encoded data including information on the validity of data, so that invalid data caused by an encoder delay or data padding can be trimmed, and providing decoded output data, may have the steps of: receiving encoded data with either information on a frame level which describes the amount of data at the beginning of frame being invalid, or information on the frame level which describes the amount of data at the end of the frame being invalid, or information on the frame level which describes both the amount of data at the beginning and the end of the frame being invalid, and providing decoded output data which only includes the samples not marked as invalid, or including all audio samples of the frame and providing information to the application which part of the data is valid.

According to another embodiment, a decoder for receiving encoded data and providing decoded output data may have: an input for receiving a series of encoded frames with a plurality of encoded audio samples therein, where some frames include information on the validity of data so that invalid data caused by an encoder delay or data padding can be trimmed, the information being formatted as described in the method for receiving encoded data including information on the validity of data, so that invalid data caused by an encoder delay or data padding can be trimmed, and providing decoded output data, which method may have the steps of: receiving encoded data with either information on a frame level which describes the amount of data at the beginning of frame being invalid, or information on the frame level which describes the amount of data at the end of the frame being invalid, or information on the frame level which describes both the amount of data at the beginning and the end of the frame being invalid, and providing decoded output data which only includes the samples not marked as invalid, or including all audio samples of the frame and providing information to the application which part of the data is valid, a decoding portion coupled to the input and configured to apply the information on the validity of data, an output for providing decoded audio samples, where either only the valid audio samples are provided, or where information on the validity of the decoded audio samples is provided.

Another embodiment may have a computer program having a program code for performing, when running on a computer, a method for providing information on the validity of encoded audio data so that invalid data caused by an encoder delay or data padding can be trimmed, the encoded audio data being a series of coded frames, wherein each coded frame can include information on the valid audio data, which method may have the steps of: providing either information on a frame level which describes the amount of data at the beginning of the frame being invalid, or providing information on the frame level which describes the amount of data at the end of the frame being invalid, or providing information on the frame level which describes both the amount of data at the beginning and the end of the frame being invalid.

Another embodiment may have a computer program having a program code for performing, when running on a computer, a method for receiving encoded data including information on the validity of data and providing decoded output data, so that invalid data caused by an encoder delay or data padding can be trimmed: receiving encoded data with either information on a frame level which describes the amount of data at the beginning of a frame being invalid, or information on the frame level which describes the amount of data at the end of the frame being invalid, or information on a the frame level which describes both the amount of data at the beginning and the end of the frame being invalid, and providing decoded output data which only includes the samples not marked as invalid, or comprising all audio samples of the frame and providing information to the application which part of the data is valid.

The problem tackled by this invention relates to another set of artifacts, which are typically not covered in audio coding literature: additional silence periods at the beginning and the end of an encoding. Solutions for these artifacts exist, which are often referred to as gap-less playback methods. The sources for these artifacts are at first the coarse granularity of coded audio data where e.g. one unit of coded audio data contains information for 1024 original un-coded audio samples. Secondly, the digital signal processing is often only possible with algorithmic delays due to the digital filters and filter banks involved.

Many applications do not require the recovery of the originally valid samples. Radio broadcasts, for example, are normally not problematic, since the coded audio stream is continuous and a concatenation of separate encodings does not happen. TV broadcasts are also often statically configured, and a single encoder is used before transmission. The extra silence periods become however a problem, when several pre-encoded streams are spliced together (as used for ad-insertion), when audio-video synchronization becomes an issue, for the storage of compressed data, where the decoding shall not exhibit the extra audio samples in the beginning and the end (especially for loss-less encoding requiring a bit-exact reconstruction of the original uncompressed audio data), and for editing in the compressed domain.

While many users already adapted to these extra silence periods, other users complain about the extra silence, which is especially problematic when several encodings are concatenated and formerly uncompressed gap-less audio data becomes interrupted when being encoded and decoded. It is an object of the invention to provide an improved approach allowing the removal of unwanted silence at the beginning and end of encodings.

Video coding using differential coding mechanisms, using I-frames, P-frames and B-frames, is not introducing any extra frames in the beginning or end. In contrast, the audio encoder typically has additional pre-pending samples. Depending on their number, they may lead to a perceptible loss of audio-video synchronization. This is often referred to as the lip-sync problem, the mismatch between the experienced motion of a speaker's mouth and the heard sound. Many applications tackle this problem by having an adjustment for lip-sync, which has to be done by the user since it's highly variable, depending on the codec in use and its settings. It is an object of the invention to provide an improved approach allowing a synchronized playback of audio and video.

Digital broadcasts became more heterogeneous in the past, with regional differences and personalized programs and adverts. A main broadcast stream is hence replaced and spliced with a local or user-specific content, which may be a live stream or pre-encoded data. The splicing of these streams mainly depends on the transmission system; however, the audio can often not be spliced perfectly, as wanted, due to the unknown silence periods. A current method is often to leave the silence periods in the signal, although these gaps in the audio signal can be perceived. It is an object of the invention to provide an improved approach allowing splicing of two compressed audio streams.

Editing is normally done in the uncompressed domain, where the editing operations are well-known. If the source material is however an already lossy coded audio signal, then even simple cut operations involve a complete new encoding, resulting in tandem coding artifacts. Hence, tandem decoding and encoding operations should be avoided. It is an object of the invention to provide an improved approach allowing cutting of a compressed audio stream.

A different aspect is the erasure of invalid audio samples in systems that involve a protected data path. The protected media path is used to enforce digital rights management and to ensure data integrity by using encrypted communication between the components of a system. In these systems this requirement can be fulfilled only if non-constant durations of an audio data unit become possible, since only at trusted elements within the protected media path audio editing operations can be applied. These trusted elements are typically only the decoders and the rendering elements.

The invention provides a novel approach for providing the information on the validity of data, differing from existing approaches that are outside the audio subsystem and/or approaches that only provide a delay value and the duration of the original data.

Embodiments of the invention are advantageous as they are applicable within the audio encoder and decoder, which are already dealing with compressed and uncompressed audio data. This enables systems to compress and decompress only valid data, as mentioned above, that do not need further audio signal processing outside the audio encoder and decoder. Embodiments of the invention enable signaling of valid data not only for file-based applications but also for stream-based and live applications, where the duration of the valid audio data is not known at the beginning of the encoding.

In accordance with embodiments of the invention the encoded stream contains validity information on an audio data unit level, which can be an MPEG-4 AAC Audio Access Unit. To conserve compatibility to existing decoders the information is put into a portion of the Access Unit which is optional and can be ignored by decoders not supporting the validity information. Such a portion is the extension payload of an MPEG-4 AAC Audio Access Unit. The invention is applicable to most existing audio coding schemes, including MPEG-1 Layer 3 Audio (MP3), and future audio coding schemes which work on a block basis and/or suffer from algorithmic delay.

In accordance with embodiments of the invention, a novel approach for the removal of invalid data is provided. The novel approach is based on already existing information available to the encoder, the decoder and the system layers embedding encoder or decoder.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
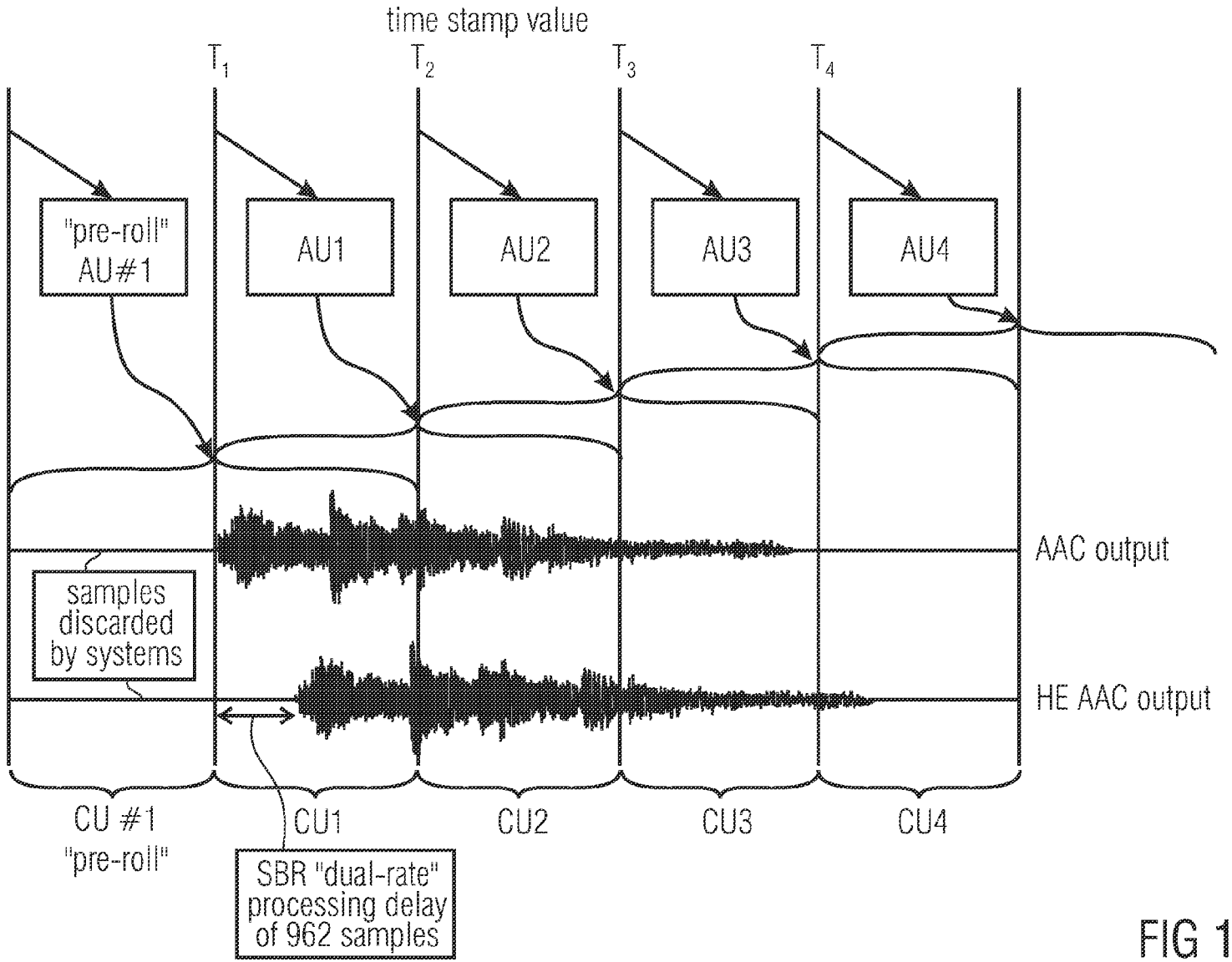
FIG. 1 illustrates an HE AAC decoder behaviour: dual-rate mode.

FIG. 1 shows the behavior of a decoder with respect to the access units (AU) and associated composition units (CU). The decoder is connected to an entity denominated "Systems" that receives an output generated by the decoder. As an example, the decoder shall be assumed to function under the HE-AAC (High Efficiency-Advanced Audio Coding) standard. A HE-AAC decoder is essentially an AAC decoder followed by an SBR (Spectral Band Reduction) "post processing" stage. The additional delay imposed by the SBR tool is due to the QMF bank and the data buffers within the SBR tool. It can be derived by the following formula:

$$\text{Delay}_{SBR\text{-}TOOL}=L_{AnalysisFilter}-N_{AnalysisChannels}+1+\text{Delay}_{buffer}$$

where $$N_{AnalysisChannels}=32,\ L_{AnalysisFilter}=320 \text{ and } \text{delay}_{buffer}=6\times 32.$$

This means that the delay imposed by the SBR tool (at the input sampling rate, i.e., the output sampling rate of the AAC) is $$\text{Delay}_{SBR\text{-}TOOL}=320-32+1+6\times 32=481$$

samples.

Typically, the SBR tool runs in the "upsampling" (or "dual rate") mode, in which case the 481 sample delay at the AAC sampling rate translates to a 962 sample delay at the SBR output rate. It could also operate at the same sampling rate as the AAC output (denoted as "downsampled SBR mode"), in which case the additional delay is only 481 samples at the SBR output rate. There is a "backwards compatible" mode in which the SBR tool is neglected and the AAC output is the decoder output. In this case there is no additional delay.

FIG. 1 shows the decoder behavior for the most common case in which the SBR tool runs in upsampling mode and the additional delay is 962 output samples. This delay corresponds to approximately 47% of the length of the upsampled AAC frame (after SBR processing). Note that T1 is the time stamp associated with CU 1 after the delay of 962 samples, that is, the time stamp for the first valid sample of HE AAC output. Further note that if HE AAC is running in "downsampled SBR mode" or "single-rate" mode, the delay would be 481 samples but the time stamp would be identical since in single-rate mode the CU's are half the number of samples so that the delay is still 47% of the CU duration.

For all of the available signaling mechanisms (i.e., implicit signaling, backward compatible explicit signaling, or hierarchical explicit signaling) if the decoder is HE-AAC then it may convey to Systems any additional delay incurred by SBR processing, otherwise the lack of an indication from the decoder indicates that the decoder is AAC. Hence, Systems can adjust the time stamp so as to compensate for the additional SBR delay.

The following section describes how an encoder and decoder for a transform-based audio codec relate to MPEG Systems and proposes an additional mechanism to ensure identity of the signal after an encoder-decoder round-trip except "coding artifacts"—especially in the presence of codec extensions. Employing the described techniques ensures a predictable operation from a Systems point of view and also removes the need for additional proprietary "gapless" signaling, normally useful for describing the encoder's behavior.

In this section, reference is made to the following standards:

[1] ISO/IEC TR 14496-24:2007: Information Technology—Coding of audio-visual objects—Part 24: Audio and systems interaction

[2] ISO/IEC 14496-3:2009 Information Technology—Coding of audio-visual objects—Part 3: Audio

[3] ISO/IEC 14496-12:2008 Information Technology—Coding of audio-visual objects—Part 12: ISO base media file format Briefly [1] is described in this section. Basically, AAC (Advanced Audio Coding) and its successors HE AAC, HE AAC v2 are codecs that do not have a 1:1 correspondence between compressed and uncompressed data. The encoder adds additional audio samples to the beginning and to the end of the uncompressed data and also produces Access Units with compressed data for these, in addition to the Access Units covering the uncompressed original data. A standards compliant decoder would then generate an uncompressed data stream containing the additional samples, being added by the encoder.

[1] describes how existing tools of the ISO base media file format [3] can be reused to mark the valid range of the decompressed data so that (besides codec artifacts) the original uncompressed stream can be recovered. The marking is accomplished by using an edit list with an entry, containing the valid range after the decoding operation.

Since this solution was not ready in time, proprietary solutions for marking the valid period are now wide-spread in use (just to name two: Apple iTunes and Ahead Nero). It could be argued that the proposed method in [1] is not very practical and suffers from the problem that edit lists were originally meant for a different—potentially complex—purpose for which only a few implementations are available.

In addition, [1] shows how pre-roll of data can be handled by using ISO FF (ISO File Format) sample groups [3]. Pre-roll does not mark which data is valid but how many Access Units (or samples in the ISO FF nomenclature) are to be decoded prior to decoder output at an arbitrary point in time. For AAC this is one sample (i.e., one Access Unit) in advance due to overlapping windows in the MDCT domain, hence the value for pre-roll is −1 for all Access Units.

Another aspect relates to the additional look-ahead of many encoders. The additional look-ahead depends e.g. on internal signal processing within the encoder that tries to create real-time output. One option for taking into account the additional look-ahead may be to use the edit list also for the encoder look-ahead delay.

As mentioned before it is questionable whether the original purpose of the edit list tool was to mark the originally valid ranges within a media. [1] is silent on the implications of further editing the file with edit lists, hence it can be assumed that using the edit list for the purpose of [1] adds some fragility.

As a side note, proprietary solutions and solutions for MP3 audio were all defining the additional end-to-end delay and the length of the original uncompressed audio data, very similar to the Nero and iTunes solutions mentioned before and what the edit list is used for in [1].

In general, [1] is silent on the correct behavior of real-time streaming applications, which do not use the MP4 file format, but involve timestamps for correct audio video synchronization and often operate in a very dumb mode. There timestamps are often set incorrectly and hence a knob may be used at the decoding device to bring everything back in sync.

The interface between MPEG-4 Audio and MPEG-4 Systems is described in more detail in the following paragraphs.

Every access unit delivered to the audio decoder from the Systems interface shall result in a corresponding composition unit delivered from the audio decoder to the systems interface, i.e., the compositor. This shall include start-up and shutdown conditions, i.e., when the access unit is the first or the last in a finite sequence of access units.

For an audio composition unit, ISO/IEC 14496-1 subclause 7.1.3.5 Composition Time Stamp (CTS) specifies that the composition time applies to the n-th audio sample within the composition unit. The value of n is 1 unless specified differently in the remainder of this subclause.

For compressed data, like HE-AAC coded audio, which can be decoded by different decoder configurations, special attention is needed. In this case, decoding can be done in a backward-compatible fashion (AAC only) as well as in an enhanced fashion (AAC+SBR). In order to ensure that composition time stamps are handled correctly (so that audio remains synchronized with other media), the following applies:

If compressed data permits both backward-compatible and enhanced decoding, and if the decoder is operating in a backwards-compatible fashion, then the decoder does not have to take any special action. In this case, the value of n is 1.

If compressed data permits both backward-compatible and enhanced decoding, and if the decoder is operating in enhanced fashion such that it is using a post-processor that inserts some additional delay (e.g., the SBR post-processor in HE-AAC), then it may ensure that this additional time delay incurred relative to the backwards-compatible mode, as described by a corresponding value of n, is taken into account when presenting the composition unit. The value of n is specified in the following table.

| Value of n | Additional delay (Note 1) | Decoder operation mode |
|---|---|---|
| 1 | 0 | A) All operation modes not listed elsewhere in this table. |
| 963 | 962 | B1) HE-AAC or HE-AAC v2 decoder with SBR operated in dual-rate mode; decoding HE-AAC or HE-AAC v2 compressed audio. |
| 482 | 481 | B2) Same as B1), but with SBR operated in downsampled mode. |

(Note 1):
The delay introduced by the post-processing is given in number of samples (per audio channel) at the output sample rate for the given decoder operation mode.

The description of the Interface between Audio and Systems has proven to work reliably, covering most of today's use-cases. If one looks carefully however, two issues are not mentioned:

In many systems the timestamp origin is the value zero. Pre-roll AUs are not assumed to exist, although e.g. AAC has an inherent minimum encoder-delay of one Access Unit that may use one Access Unit in front of the Access Unit at timestamp zero. For the MP4 file format a solution for this problem is described in [1].

Non-integer durations of the frame size are not covered. The AudioSpecificConfig( ) structure allows the signaling of a small set of framesizes which describe the filter bank lengths, e.g. 960 and 1024 for AAC. Real-world data, however, does typically not fit onto a grid of fixed framesizes and hence an encoder has to pad the last frame.

These two left-out issues became a problem recently, with the advent of advanced multimedia applications that may use the splicing of two AAC streams or the recovery of the range of valid samples after an encoder-decoder round-trip—especially in the absence of the MP4 file format and the methods described in [1].

To overcome the problems mentioned before, pre-roll, post-roll and all other sources have to be described properly. In addition a mechanism for non-integer multiples of the framesize is needed to have sample-accurate audio representations.

Pre-roll may be used initially for a decoder so that it is able to decode the data fully. As an example, AAC may use a pre-roll of 1024 samples (one Access Unit) before the decoding of an Access Unit so that the output samples of the overlap-add operation represent the desired original signal, as illustrated in [1]. Other audio codecs may have different pre-roll requirements.

Post-roll is equivalent to pre-roll with the difference that more data after the decoding of an Access Unit is to be fed to the decoder. The cause for post-roll is codec extensions which raise a codec's efficiency in exchange for algorithmic delay, such as listed in the table above. Since a dual-mode operation is often desired, the pre-roll remains constant so that a decoder without the extensions implemented can fully utilize the coded data. Hence, pre-roll and timestamps relate to the legacy decoder capabilities. Post-roll may then be used in addition for a decoder supporting these extensions, since the internally existing delay line has to be flushed to retrieve the entire representation of the original signal. Unfortunately, post-roll is decoder dependent. It is however possible to handle pre-roll and post-roll independent of the decoder if the pre-roll and post-roll values are known to the systems layer and the decoder's output of pre-roll and post-roll can be dropped there.

With respect to a variable audio frame size, since audio codecs encode blocks of data with a fixed number of samples, a sample-accurate representation becomes only possible by further signaling on the Systems level. Since it is easiest for a decoder to handle sample-accurate trimming, it seems desirable to have the decoder cut a signal. Hence, an optional extension mechanism is proposed which allows the trimming of output samples by the decoder.

Regarding a vendor-specific encoder delay, MPEG only specifies the decoder operation, whereas encoders are only provided informally. This is one of the advantages of MPEG technologies, where encoders can improve over time to fully utilize the capabilities of a codec. The flexibility in designing an encoder has however lead to delay interoperability problems. Since encoders typically need a preview of the audio signal to make smarter encoding decisions, this is highly vendor-specific. Reasons for this encoder delay are e.g. block-switching decisions, which involve a delay of the possible window overlaps and other optimizations, which are mostly relevant for real-time encoders.

File-based encoding of offline available content does not require this delay which is only relevant when real-time data is encoded, nevertheless, most encoders do prepend silence also to the beginning of offline encodings.

One part of the solution for this problem is the correct setting of timestamps on the systems layer so that these delays are irrelevant and have e.g. negative timestamp values. This can also be accomplished with the edit list, as proposed in [1].

The other part of the solution is an alignment of the encoder delay to frame boundaries, so that an integer number of Access Units with e.g. negative timestamps can be skipped initially (besides the pre-roll Access Units).

The teachings disclosed herein also relate to the industrial standard ISO/IEC 14496-3:2009, subpart 4, section 4.1.1.2. According to the teachings disclosed herein, the following is proposed: When present, a post-decoder trimming tool selects a portion of the reconstructed audio signal, so that two streams can be spliced together in the coded domain and sample-accurate reconstruction becomes possible within the Audio layer.

The input to the post-decoder trimming tool is:

The time domain reconstructed audio signal

The post-trim control information

The output of the post-decoder trimming tool is:

The time domain reconstructed audio signal

If the post-decoder trimming tool is not active, the time domain reconstructed audio signal is passed directly to the output of the decoder. This tool is applied after any previous audio coding tool.

The following table illustrates a proposed syntax of a data structure extension_payload( ) that may be used to implement the teachings disclosed herein.

| Syntax | No. of bits | Mnemonic |
|---|---|---|
| extension_payload(cnt) | | |
| { | | |
| extension_type; | 4 | uimsbf |
| align = 4; | | |
| switch( extension_type ) { | | |
| case EXT_TRIM: | | |
| return trim_info( ); | | |
| case EXT_DYNAMIC_RANGE: | | |
| return dynamic_range_info( ); | | |
| case EXT_SAC_DATA: | | |
| return sac_extension_data(cnt); | | |
| case EXT_SBR_DATA: | | |
| return sbr_extension_data(id_aac, 0); | | Note 1 |
| case EXT_SBR_DATA_CRC: | | |
| return sbr_extension_data(id_aac, 1); | | Note 1 |
| case EXT_FILL_DATA: | | |
| fill_nibble; /* may be '0000' */ | 4 | uimsbf |
| for (i=0; i<cnt−1; i++) { | | |
| fill_byte[i]; /* may be '10100101' */ | 8 | uimsbf |
| } | | |
| return cnt; | | |
| case EXT_DATA_ELEMENT: | | |
| data_element_version; | 4 | uimsbf |
| switch( data_element_version ) { | | |
| case ANC_DATA: | | |
| loopCounter = 0; | | |
| dataElementLength = 0; | | |
| do { | | |
| dataElementLengthPart; | 8 | uimsbf |
| dataElementLength += dataElementLengthPart; | | |
| loopCounter++; | | |
| } while (dataElementLengthPart == 255); | | |
| for (i=0; i<dataElementLength; i++) { | | |
| data_element_byte[i]; | 8 | uimsbf |
| } | | |
| return (dataElementLength+loopCounter+1); | | |
| default: | | |
| align = 0; | | |
| } | | |
| case EXT_FIL: | | |
| default: | | |
| for (i=0; i<8*(cnt−1)+align; i++) { | | |
| other_bits[i]; | 1 | uimsbf |
| } | | |
| return cnt; | | |
| } | | |
| } | | |

Note 1:

id_aac is the id_syn_ele of the corresponding AAC element (ID_SCE or ID_CPE) or ID_SCE in case of CCE.

The following table illustrates a proposed syntax of a data structure trim_info( ) that may be used to implement the teachings disclosed herein.

| Syntax | No. of bits | Mnemonic |
|---|---|---|
| trim_info( ) | | |
| { | | |
| custom_resolution_present; | 1 | uimsbf |
| trim_resolution = samplingFrequency; | | |
| if (custom_resolution_present == 1 ) { | | |
| custom_resolution; | 19 | uimsbf |
| trim_resolution = custom_resolution; | | |
| } | | |
| trim_from_beginning; | 12 | uimsbf |
| trim_from_end; | 12 | uimsbf |
| } | | |

with the following definitions relative to Post-Decoder Trimming:

custom_resolution_present Flag that indicates whether the custom_resolution is present.

custom_resolution A custom resolution in Hz that is used for the trimming operation. It is recommended to set a custom resolution when multi-rate processing of the audio signal is possible and the trimming operation needs to be performed with the highest suitable resolution.

trim_resolution The default value is the nominal sampling frequency as indicated in Table 1.16 of ISO/IEC 14496-3: 2009 by samplingFrequency or samplingFrequencyIdx. If the custom_resolution_present flag is set then the resolution for the post-decoder trimming tool is the value of custom_resolution.

trim_from_beginning ($N_B$) Number of PCM samples to be removed from the beginning of the Composition Unit. The value is only valid for an audio signal with trim_resolution rate. If trim_resolution is not equal to the sampling frequency of the time-domain input signal, the value has to be scaled appropriately according to the following equation:

$$N_B = \text{floor}(N_B \cdot \text{sampling_frequency}/\text{trim_resolution})$$

trim_from_end ($N_E$) Number of PCM samples to be removed from the end of the Composition Unit. If the trim_resolution is not equal to the sampling frequency of the time-domain input signal, the value has to be scaled appropriately according to the following equation:

$$N_E = \text{floor}(N_E \cdot \text{sampling_frequency}/\text{trim_resolution})$$

Another possible stream mixing algorithm may take seamless splicing (without the possibility of signal discontinuities) into account. This issue is also valid for uncompressed PCM data and it is orthogonal to the teachings disclosed herein.

Instead of a custom resolution a percentage may also be appropriate. Alternatively, the highest sampling rate may be used but this may conflict with dual-rate processing and decoders that support trimming but not dual-rate processing, hence a decoder implementation independent solution is advantageous and a custom trim resolution seemed sensible.

Regarding the decoding process, post-Decoder trimming is applied after all data of an Access Unit is processed (i.e., after extensions like DRC, SBR, PS, etc. have been applied). The trimming is not done on the MPEG-4 Systems layer; however, timestamps and duration values of an Access Unit shall match the assumption that trimming is applied.

The trimming is applied for the Access Unit that carries the information only if no extra delay due to optional extensions (e.g. SBR) has been introduced. If these extensions are in place and are used within the decoder, then the application of the trimming operation is delayed by the optional extensions' delay. Hence, the trimming information needs to be stored inside the decoder and further Access Units may be provided by the Systems layer.

If the decoder can operate at more than one rate, it is recommended to use a custom resolution for the trimming operation with the highest rate.

Trimming may lead to signal discontinuities, which can cause signal distortion. Hence, trimming information should only be inserted into the bitstream at the beginning or the end of the entire encoding. If two streams are spliced together, these discontinuities can not be avoided except by an encoder that carefully sets the values of trim_from_end and trim_from_beginning so that the two output time-domain signals fit together without discontinuities.

Trimmed Access Units may lead to unexpected computational requirements. Many implementations assume constant processing time for Access Units with constant duration, which is no more valid if the duration changes due to trimming but the computational requirements for an Access Unit remain. Hence, decoders with constrained computational resources should be assumed and trimming should hence be used rarely, advantageously by encoding data in a way that it is aligned to the Access Unit boundaries and only trimming at the end of an encoding is used, as described in [ISO/IEC 14496-24:2007 Annex B.2].

The teachings disclosed herein also relate to the industrial standard ISO/IEC 14496-24:2007. According to the teachings disclosed herein, the following is proposed relative to an audio decoder interface for sample-accurate Access: An audio decoder will create one Composition Unit (CU) from one Access Unit (AU). The amount of pre-roll and post-roll AUs that may be used is constant for a serial set of AUs by one encoder.

When the decoding operation starts, the decoder is initialized with an AudioSpecificConfig (ASC). After the decoder has processed this structure, the most relevant parameters can be requested from the decoder. In addition, the Systems layer conveys parameters that are in general independent from the type of stream, be it audio or video or other data. This includes timing information, pre-roll and post-roll data. In general, the decoder needs $r_{pre}$ pre-roll AUs before the AU, that contains the requested sample. In addition, $r_{post}$ post-roll are needed, this depends however on the decoding mode (decoding an extension may involve post-roll AUs whereas the basic decoding operation is defined as not involving a post-roll AU).

Each AU should be marked for the decoder whether it is a pre-roll or post-roll AU, to enable the decoder to create the r internal state information that may be used for subsequent decoding or to flush remaining data inside the decoder, respectively.

Figure 2:
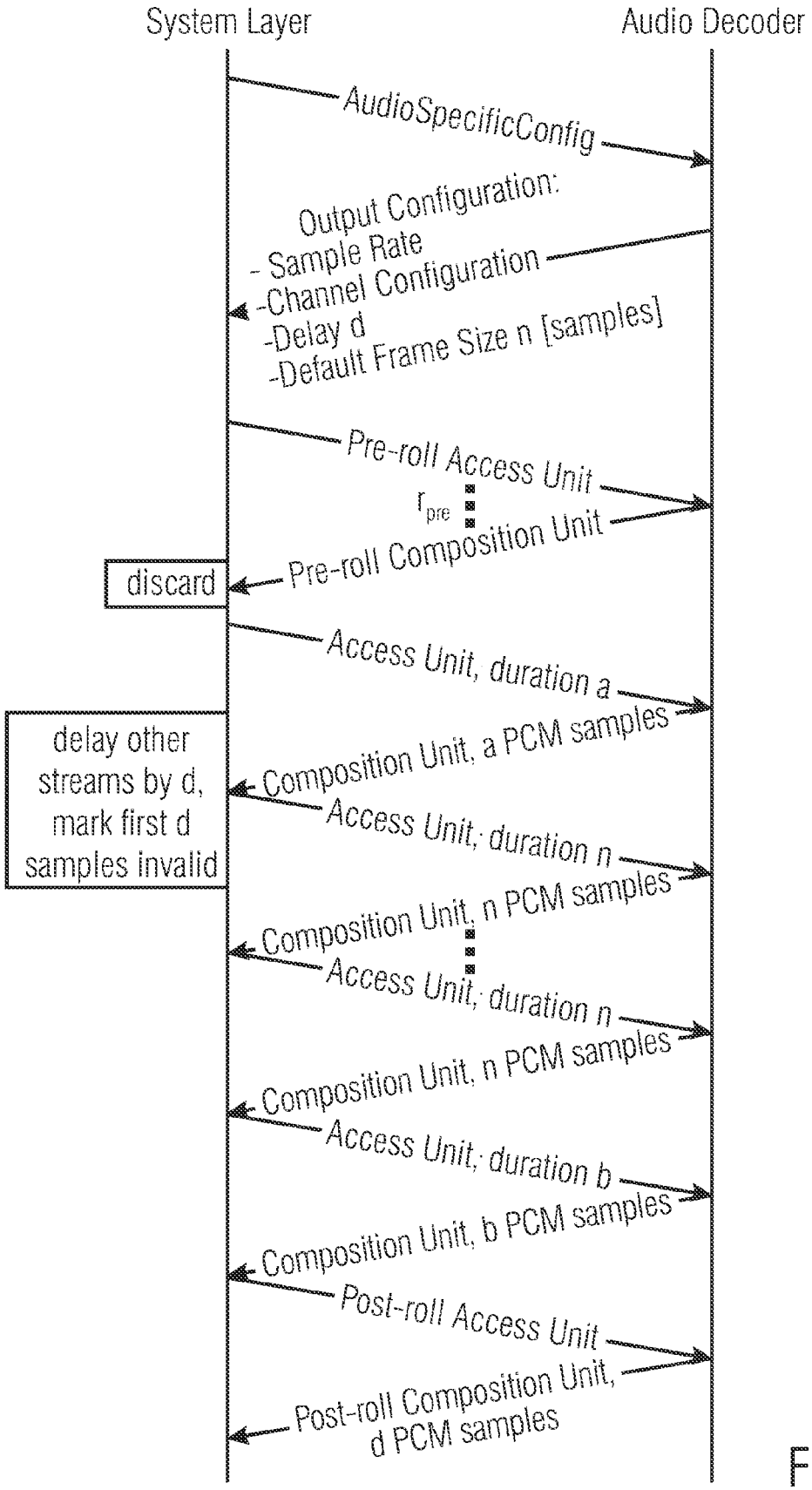
FIG. 2 illustrates an information exchange between a Systems Layer entity and an audio decoder.

The communication between the systems layer and the audio decoder is illustrated in FIG. 2.

The audio decoder is initialized by the Systems layer with an AudioSpecificConfig( ) structure, which results in an output configuration of the decoder to the Systems layer, containing information on sample frequency, the channel configuration (e.g. 2 for stereo), the framesize n (e.g. 1024 in the case of AAC LC) and an extra delay d for explicitly signalled codec extensions, such as SBR. In particular, FIG. 2 shows the following actions:

1. The first $r_{pre}$ pre-roll Access Units are provided to the decoder and silently discarded after decoding by the Systems layer.
2. The first non-pre-roll Access Unit may contain trim_from_beginning information in an extension payload of type EXT_TRIM so that the decoder only outputs a PCM samples. In addition, the extra d PCM samples, generated by an optional codec extension, have to be erased.

Depending on the implementation this may happen by delaying all other parallel streams by d or by marking the first d samples as invalid and taking appropriate action such as erasing the invalid samples at the time of rendering, or advantageously within the decoder.

If the erasure of the d samples happens within the decoder, as recommended, then the systems layer needs to be aware that the first Composition Unit containing a samples can only be provided by the decoder after consumption of $r_{post}$ Access Units, as outlined in the $6^{th}$ step.

3. Then all Access Units with the constant duration n are decoded and the Composition Units are provided to the Systems layer.
4. The Access Unit before the post-roll Access Units may contain optional trim_from_end information so that the decoder only generates b PCM samples.
5. The last $r_{post}$ post-roll Access Units are provided to the audio decoder so that the missing d PCM samples can be generated. Depending on the value of d (which may be zero) this may result in Composition Units without any samples. It is recommended to provide all post-roll Access Units to the decoder so that it can fully de-initialize, independently of the value of the extra delay d.

Encoders should have consistent timing behavior. An encoder should align the input signal so that after decoding $r_{pre}$ pre-roll AUs the original input signal would result, without initial loss and without heading samples. Especially for file-based encoder operations this would mean that the encoder's additional look-ahead samples and additionally inserted silence samples are an integer multiple of the audio frame size and can thus be discarded at the encoder's output.

In scenarios where such an alignment is not possible, e.g. real-time encoding of audio, the encoder should insert trimming information so that the decoder is enabled to erase accidentally inserted look-ahead samples with the post-decoder trimming tool. Similarly, encoders should insert post-decoder trimming information for trailing samples. These shall be signaled in the Access Unit that precedes the last $r_{post}$ post-roll AUs.

The timing information set at the encoder shall be set assuming that the post-decoder trimming tool is available.

Figure 3:
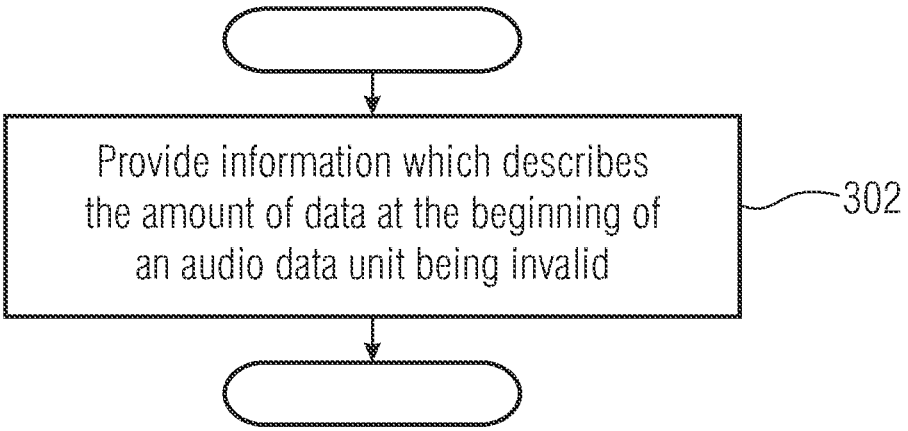
FIG. 3 shows a schematic flow diagram of a method for providing information on the validity of encoded audio data according to a first possible embodiment.

FIG. 3 shows a schematic flow diagram of a method for providing information on the validity of encoded audio data according to a first possible embodiment. The method comprises an action 302 according to which information is provided that describes the amount of data at the beginning of an audio data unit being invalid. The provided information may then be inserted in, or combined with, the coded audio data unit that is concerned. The amount of data may be expressed as a number of samples (for example, PCM samples), microseconds, milliseconds, or a percentage of a length of an audio signal section provided by the coded audio data unit.

Figure 4:
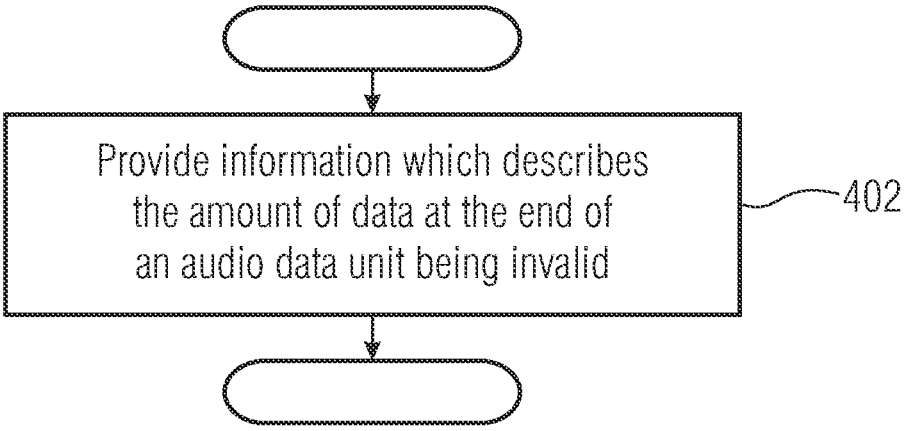
FIG. 4 shows a schematic flow diagram of a method for providing information on the validity of encoded audio data according to a second possible embodiment of the teachings disclosed herein.

FIG. 4 shows a schematic flow diagram of a method for providing information on the validity of encoded audio data according to a second possible embodiment of the teachings disclosed herein. The method comprises an action 402, according to which information is provided that describes the amount of data at the end of an audio data unit being invalid.

Figure 5:
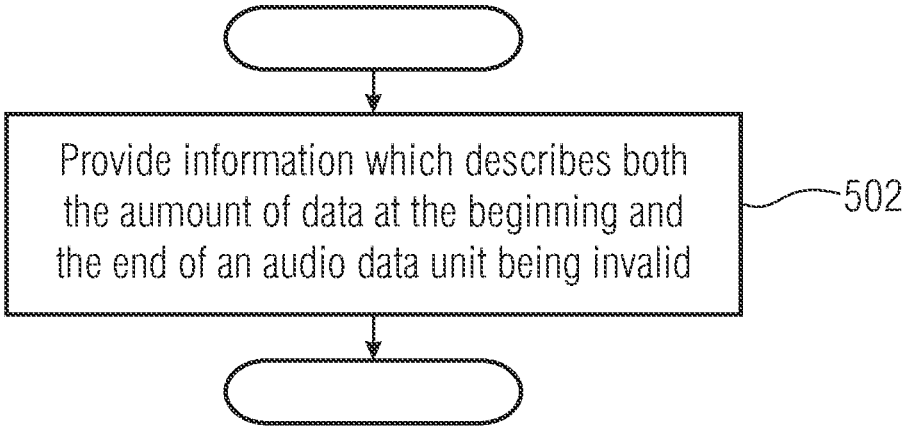
FIG. 5 shows a schematic flow diagram of a method for providing information on the validity of encoded audio data according to a third possible embodiment of the teachings disclosed herein.

FIG. 5 shows a schematic flow diagram of a method for providing information on the validity of encoded audio data according to a third possible embodiment of the teachings disclosed herein. The method comprises an action 502 according to which information is provided that describes both the amount of data at the beginning and the end of an audio data unit being invalid.

In the embodiments illustrated in FIGS. 3 to 5, the information describing the amount of data within the audio data unit being invalid may be obtained from an encoding process that generates the encoded audio data. During the encoding of audio data, an encoding algorithm may consider an input range of audio samples that extends over a boundary (beginning or end) of an audio signal to be encoded. Typical encoding processes gather a plurality of audio samples in "blocks" or "frames" so that a block or frame that is not completely filled with actual audio samples may be filled up with "dummy" audio samples that typically have a zero amplitude. For the encoding algorithm this offers the advantage that the input data is organized in the same manner so that the data processing within the algorithm does not have to be modified depending on the processed audio data containing a boundary (beginning or end). In other words, the inputted data is conditioned, with respect to data organization and dimension, to the requirements of the encoding algorithm. Typically, the conditioning of the input data inherently leads to a corresponding structure of the output data, i.e., the output data reflects the conditioning of the input data. Hence, the outputted data differs from the original input data (before the conditioning). This difference is typically inaudible because only samples having a zero amplitude have been added to the original audio data. Nevertheless, the conditioning may modify the duration of the original audio data, typically lengthening the original audio data by silent segments.

Figure 6:
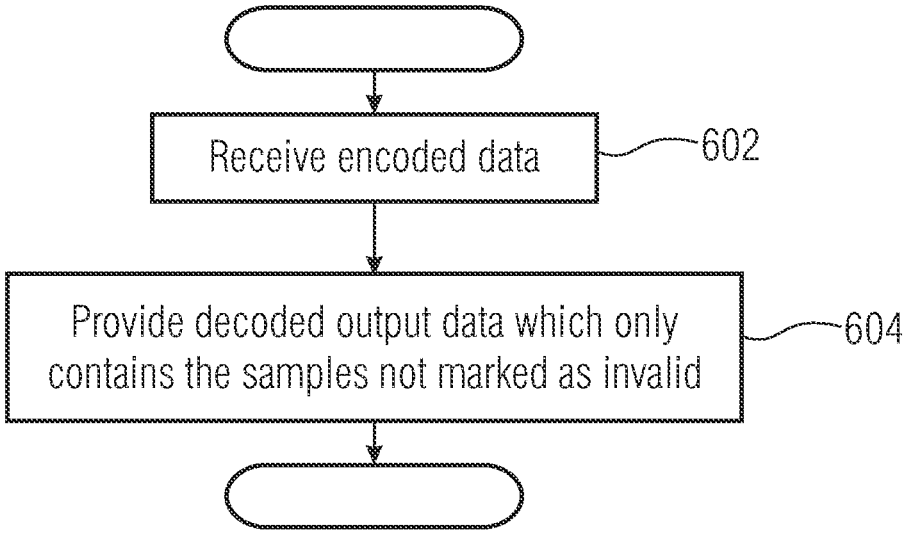
FIG. 6 shows a schematic flow diagram of a method for receiving encoded data including the information on the validity of data according to an embodiment of the teachings disclosed herein.

FIG. 6 shows a schematic flow diagram of a method for receiving encoded data including the information on the validity of data according to an embodiment of the teachings disclosed herein. The method comprises an action 602 of receiving the encoded data. The encoded data contains information which describes the amount of data being invalid. At least three cases can be distinguished: the information may describe the amount of data at the beginning of an audio data unit being invalid, the amount of data at the end of an audio data unit being invalid, and the amount of data at the beginning and the end of an audio data unit being invalid.

At an action 604 of the method for receiving encoded data, decoded output data is provided which only contains the samples not marked as invalid. A consumer of the decoded output data downstream of an element executing the method for receiving encoded data may use the provided decoded output data without having to deal with the issue of the validity of portions of the output data, such as single samples.

Figure 7:
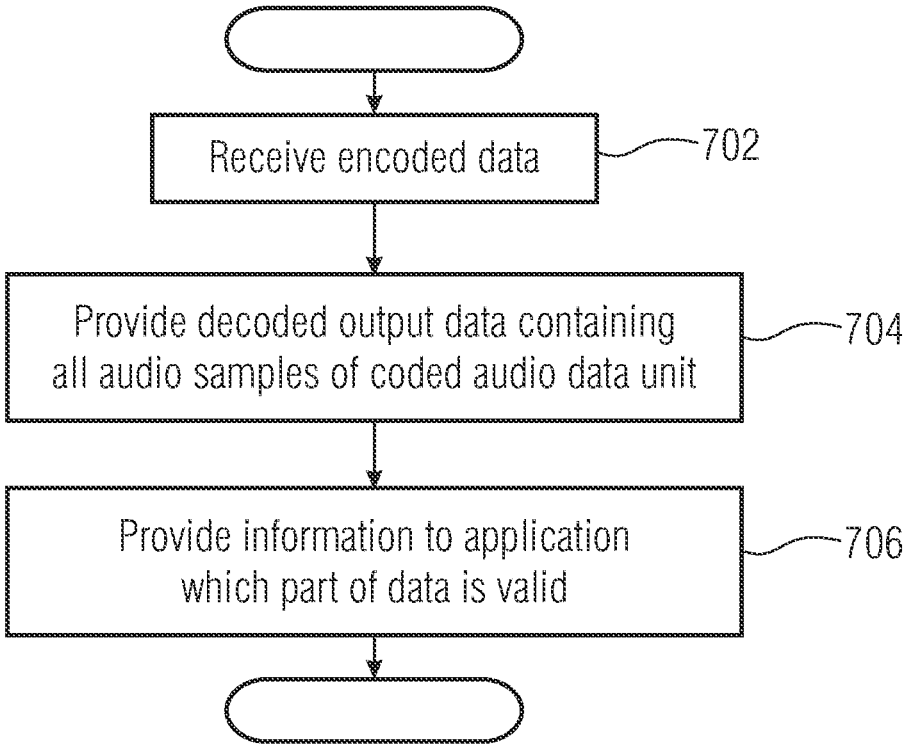
FIG. 7 shows a schematic flow diagram of the method for receiving encoded data according to another embodiment of the teachings disclosed herein.

FIG. 7 shows a schematic flow diagram of the method for receiving encoded data according to another embodiment of the teachings disclosed herein. The encoded data is received at an action 702. At an action 704, decoded output data containing all audio samples of a coded audio data unit are provided, for example to a downstream application consuming the decoded output data. In addition, information is provided, via an action 706, which part of the decoded output data is valid. The application consuming the decoded output data may then strip invalid data and concatenate successive segments of valid data, for example. In this manner, the decoded output data can be processed by the application to not contain artificial silences.

Figure 8:
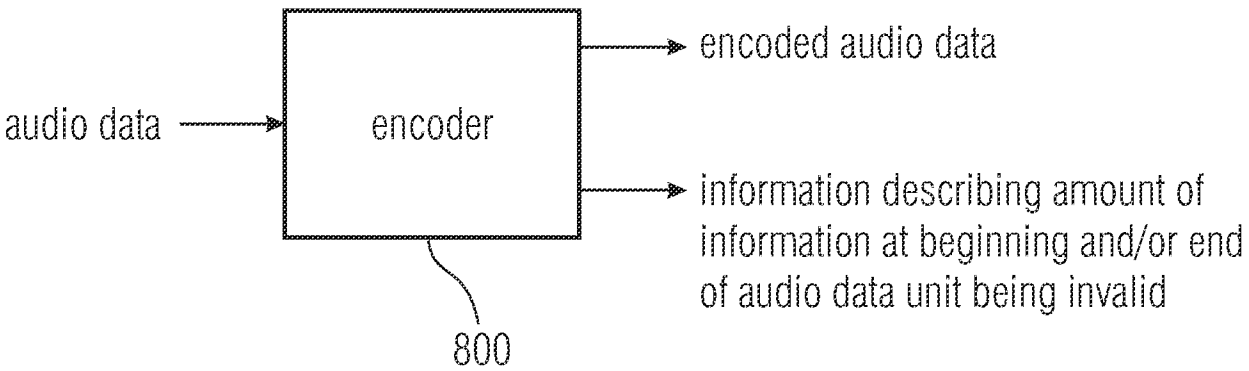
FIG. 8 shows an input/output diagram of an encoder according to an embodiment of the teachings disclosed herein.

FIG. 8 shows an input/output diagram of an encoder 800 according to an embodiment of the teachings disclosed herein. The encoder 800 receives audio data, for example a stream of PCM samples. The audio data is then encoded using a loss-less encoding algorithm or a lossy encoding algorithm. During execution, the encoding algorithm may have to modify the audio data provided at an input of the encoder 800. A reason for such a modification may be to make the original audio data fit the requirements of the encoding algorithm. As mentioned above, a typical modification of the original audio data is the insertion of extra audio samples so that the original audio data fits into an integer number of frames or blocks, and/or so that the encoding algorithm is properly initialized before the first true audio sample is being processed. Information about the performed modification may be obtained from the encoding algorithm or an entity of the encoder 800 performing the conditioning of the input audio data. From this modification information, an information may be derived which describes the amount of information at a beginning and/or an end of an audio data unit that is invalid. The encoder 800 may for example comprise a counter for counting samples marked as invalid by the encoding algorithm or the input audio data conditioning entity. The information describing the amount of information at the beginning and/or the end of the audio data unit being invalid is provided at an output of the encoder 800 along with the encoded audio data.

Figure 9:
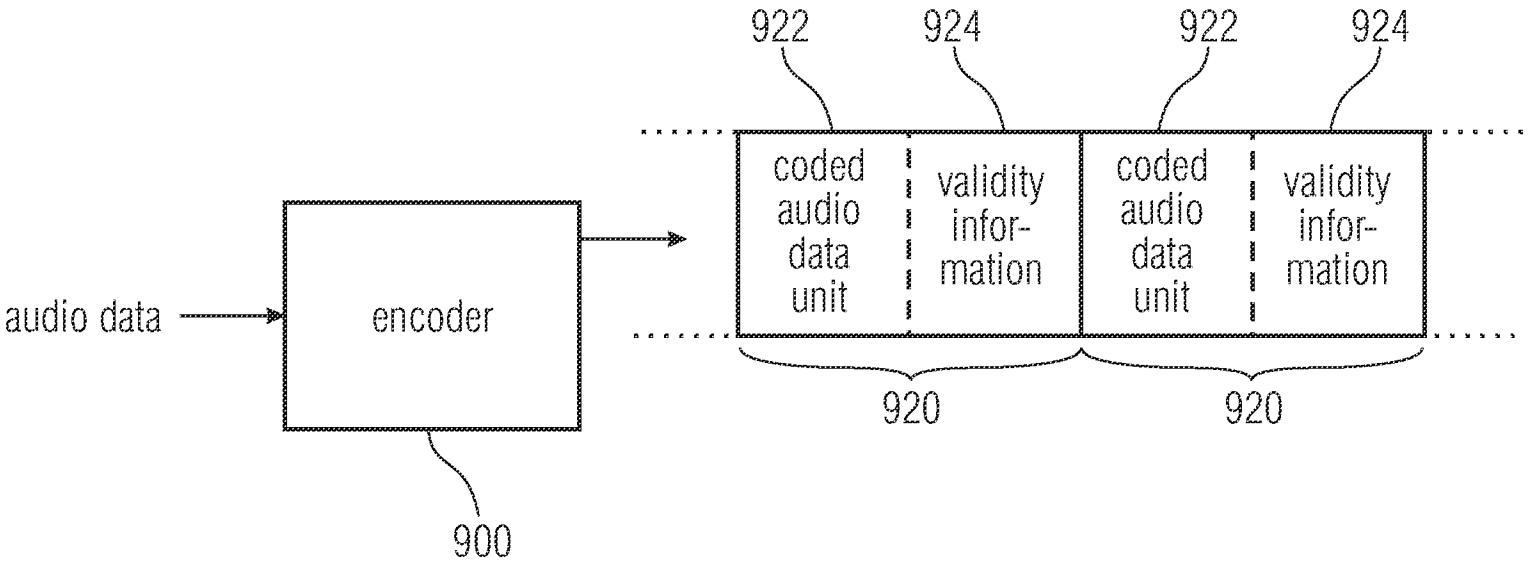
FIG. 9 shows a schematic input/output diagram of an encoder according to another embodiment of the teachings disclosed herein.

FIG. 9 shows a schematic input/output diagram of an encoder 900 according to another embodiment of the teachings disclosed herein. Compared to the encoder 800 shown in FIG. 8, the output of the encoder 900 shown in FIG. 9 follows a different format. The encoded audio data output by the encoder 900 is formatted as a stream or series of coded audio data units 922. Along with each coded audio data unit 922, a validity information 924 is contained in the stream. A coded audio data unit 922 and its corresponding validity information 924 may be regarded as an enhanced coded audio data unit 920. Using the validity information 924, a receiver of the stream of enhanced audio data units 920 may decode the coded audio data units 922 and use those parts only, that are marked as valid data. Note that the term "enhanced coded audio data unit" does not necessarily imply that its format is different from non-enhanced coded audio data units. For example, the validity information may be stored in a currently unused data field of a coded audio data unit.

Figure 10:
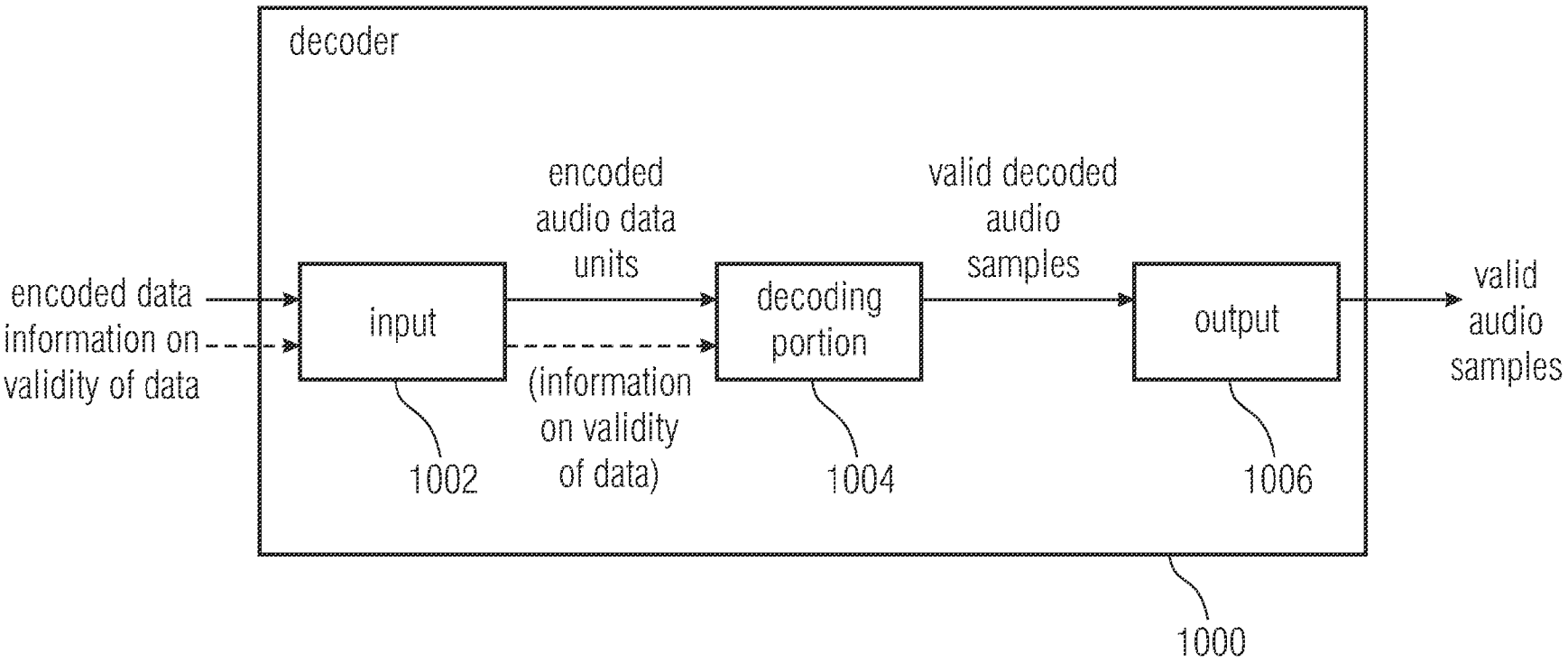
FIG. 10 shows a schematic block diagram of a decoder according to an embodiment of the teachings disclosed herein.

FIG. 10 shows a schematic block diagram of a decoder 1000 according to an embodiment of the teachings disclosed herein. The decoder 1000 receives encoded data at an input 1002 which forwards encoded audio data units to a decoding portion 1004. The encoded data comprises information on the validity of data, as described above with respect to the description of the method for providing information on the validity of encoded audio data or the corresponding encoder. The input 1002 of the decoder 1000 may be configured to receive information on the validity of data. This feature is optional as indicated by the dashed arrow leading to the input 1002. Furthermore, the input 1002 may be configured to provide the information on the validity of data to the decoding portion 1004. Again, this feature is optional. The input 1002 may simply forward the information on the validity of data to the decoding portion 1004, or the input 1002 may extract the information on the validity of data from the encoded data in which the information on the validity of data is contained. As an alternative to the input 1002 handling the information on the validity of data, the decoding portion 1004 could extract this information and use it to filter invalid data. The decoding portion 1004 is connected to an output 1006 of the decoder 1000. Valid decoded audio samples are transmitted or sent by the decoding portion 1004 to the output 1006 which provides valid audio samples to a downstream consuming entity of the valid audio samples, such as an audio renderer. The processing of the information on the validity of data is transparent to the downstream consuming entity. At least one of the decoding portion 1004 and the output 1006 may be configured to arrange the valid decoded audio samples so that no gap occurs, even if invalid audio samples have been removed from a stream of audio samples to be presented to the downstream consuming entity.

Figure 11:
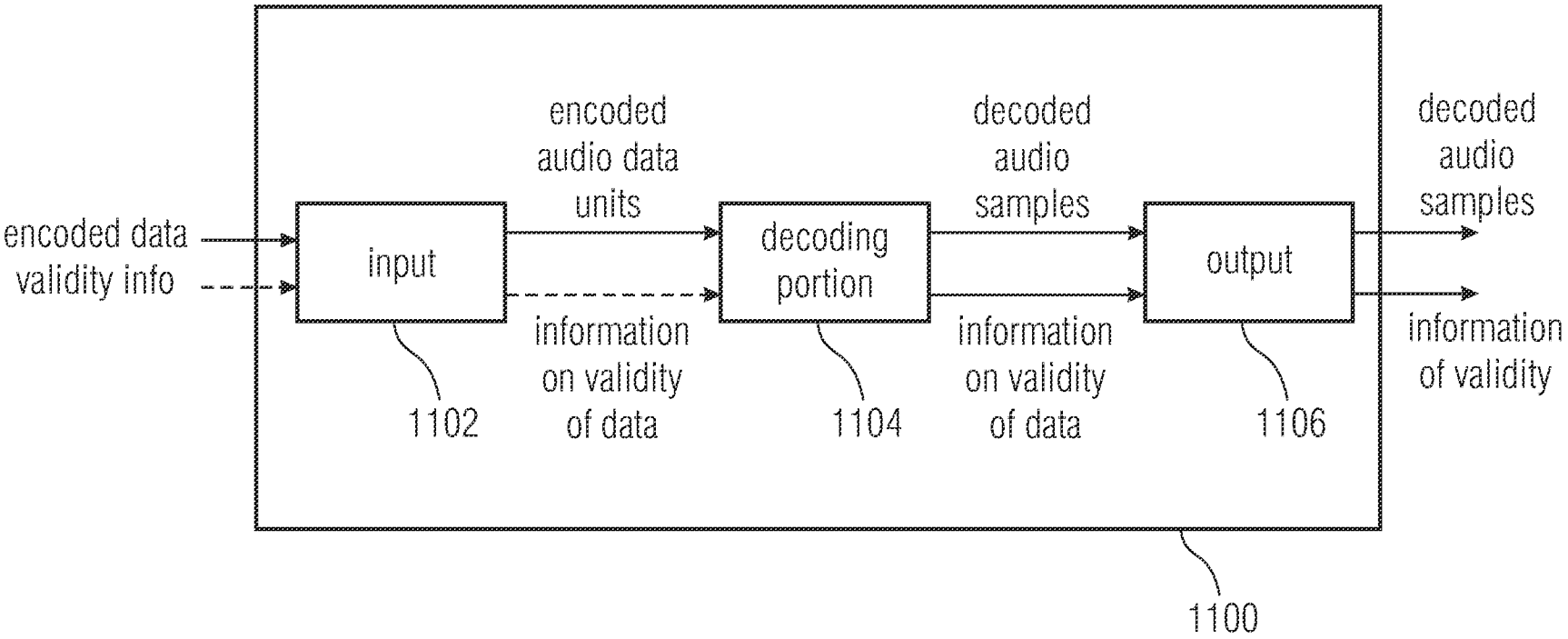
FIG. 11 shows a schematic block diagram of a decoder according to another embodiment of the teachings disclosed herein.

FIG. 11 shows a schematic block diagram of a decoder 1100 according to another embodiment of the teachings disclosed herein. The decoder 1100 comprises an input 1102, the decoding portion 1104 and an output 1106. The input 1102 receives encoded data and provides encoded audio data units to the decoding portion 1104. As explained above in connection with the decoder 1000 shown in FIG. 10, the input 1102 may, as an option, receive separate validity information which may then be forwarded to the decoding portion 1104. The decoding portion 1104 converts the encoded audio data units to decoded audio samples and forwards those to the output 1106. In addition, the decoding portion also forwards the information on the validity of data to the output 1106. In case the information on the validity of data has not been provided by the input 1102 to the decoding portion 1104, the decoding portion 1104 may determine the information on the validity of data itself. The output 1106 provides the decoded audio samples and the information on the validity of the data to a downstream consuming entity.

The downstream consuming entity may then exploit the information on the validity of the data itself. The decoded audio samples generated by the decoding portion 1104 and provided by the output 1106 contain, in general, all decoded audio samples, i.e., valid audio samples and invalid audio samples.

The method for providing the information on the validity of encoded audio data may use various pieces information in order to determine the amount of data of an audio data unit that is invalid. Also the encoder may use these pieces of information. The following sections describe a number of pieces of information that may be used to this end: amount of pre-roll data, amount of extra artificial data added by the encoder, length of original uncompressed input data, and amount of post-roll.

One important piece of information is the amount of pre-roll data, which is the amount of compressed data which has to be decoded before the compressed data unit corresponding to the beginning of the original uncompressed data. Exemplary, an encoding and decoding of a set of uncompressed data units is explained. Given a frame-size of 1024 samples and the amount of pre-roll also 1024 samples, an original uncompressed PCM audio data set consisting of 2000 samples will be encoded as three encoded data units. The first encoded data unit will be the pre-roll data unit with a duration of 1024 samples. The second encoded data unit will result in the original 1024 samples of the source signal (given no other encoding artifacts). The third encoded data unit will result in 1024 samples, consisting of the remaining 976 samples of the source signal and 48 trailing samples introduced by the frame granularity. Due to the properties of the coding methods, such as an MDCT (modified discrete cosine transform) or a QMF (quadrature mirror filter) involved, the pre-roll can not be avoided and is essential for the decoder to reconstruct the entire original signal. Hence, for the example above one compressed data unit more than expected by a non-expert may be used. The amount of pre-roll data is coding-dependent and fixed for a coding mode and constant over time. Therefore it may also be used for randomly accessing compressed data units. The pre-roll may also be used to get the decoded uncompressed output data corresponding to the uncompressed input data.

Another piece of information is the amount of extra artificial data added by the encoder. This extra data typically results from a preview of future samples within the encoder so that smarter decisions on encoding can be made, like switching from short filter banks to long filter banks. Only the encoder knows this look-ahead value and it is different between encoder implementations of a specific vendor for the same coding mode, although constant over time. The length of this extra data is difficult to detect by a decoder and often heuristics are applied, e.g. the amount of silence in the beginning is assumed to be extra encoder delay or a magic value if a certain encoder is detected by some other heuristics.

The next piece of information only available to the encoder is the length of the original uncompressed input data. In the example above 48 trailing samples are created by the decoder which have not been present in the original input uncompressed data. The reason is the frame granularity, which is fixed to a codec-dependent value. A typical value is 1024 or 960 for MPEG-4 AAC, hence the encoder pads the original data to fit onto the frame-size grid. Existing solutions typically add metadata on the system level which contains the sum of all heading extra samples, resulting from pre-roll and extra artificial data, and the length of the source audio data. This method however works for file-based operations only, where the duration is known before encoding. It also has some fragility when edits to the file are made; then also the meta data needs to be updated. An alternative approach is the usage of timestamps or durations on the system level. Using these does unfortunately not clearly define which half of the data is valid. In addition the trimming can typically not be done on the system level.

Lastly, another piece of information became increasingly important, which is the amount of post-roll information. Post-roll defines how much data may be given to a decoder after the coded data unit so that the decoder can provide the uncompressed data corresponding to the uncompressed original data. In general, post-roll can be exchanged with pre-roll and vice-versa. However, the sum of post-roll and pre-roll is not constant for all decoder modes. Current specifications such as [ISO/IEC 14496-24:2007] assume a fixed pre-roll for all decoder modes and ignore mentioning post-roll in favor of defining additional delay which has an equivalent value to post-roll. Although illustrated in FIG. 4 of [ISO/IEC 14496-24:2007] it is not mentioned that the last coded data unit (an Access Unit, AU, in the MPEG terminology) is optional and is actually a post-roll AU which is only needed for the dual-rate processing of a decoder with a low rate and an extension with the doubled rate. It is an embodiment of the invention to also define a method for the removal of invalid data in the presence of post-roll.

The information above is e.g. partially used in [ISO/IEC 14496-24:2007] for MPEG-4 AAC in the MP4 File Format [ISO/IEC 14496-14]. There a so-called edit list is used to mark the valid portion of the coded data by defining an offset and a validity period for the coded data in a so-called edit. Also the amount of pre-roll can be defined on a frame granularity. A disadvantage of this solution is the usage of the edit list for overcoming audio-coding specific problems. This conflicts with the previous use of edit lists to define generic non-linear editing without data modification. Hence it becomes difficult or even impossible to distinct between the audio-specific edits and generic edits.

Another potential solution is the method for recovery of the original file length in mp3 and mp3Pro. There the codec delay and the total duration of the file are provided in the first coded audio data unit. This unfortunately has the issue that it only works for file-based operations or streams with the entire length already known when the encoder creates the first coded audio data unit, since the information is contained therein.

To overcome the disadvantages of existing solutions, embodiments of the invention provide information on the validity of the data at the output of the encoder within the coded audio data. The pieces of information are attached to the coded audio data units which are affected. Hence, artificial extra data at the beginning is marked as invalid data and trailing data used to fill a frame is also marked as invalid data which has to be trimmed. The marking, according to the embodiments of the invention, allows the distinction of valid vs. invalid data within a coded data unit, so that a decoder can erase the invalid data before it provides data to the output or can alternatively mark the data, e.g. in a similar manner to the representation within the coded data unit, so that appropriate actions can happen at other processing elements. The other relevant data, which is the pre-roll and post-roll is defined within the system and understood by both the encoder and decoder, so that for a given decoder mode the values are known.

Hence an aspect of the disclosed teachings proposes the separation of time-variant data and time-invariant data. The time-variant data consists of the information on artificial extra data which is only present in the beginning and the trailing data used to fill a frame. The time-invariant data consists of the pre-roll and post-roll data and needs thus not be transmitted in coded audio data units but should be transmitted rather out-of-band or are known in advance by the decoding mode, which can be derived from the decoder configuration record for a given audio coding scheme.

It is further recommended to set timestamps of coded audio data according to the information a coded audio data unit represents. Hence, an original uncompressed audio sample with timestamp t is assumed to be recovered by the decoding operation of the coded audio data unit with timestamp t. This does not include pre-roll or post-roll data units, which are needed in addition. For example, a given original audio signal with 1500 samples and an initial timestamp with value 1 would be encoded as three coded audio data units of frame-size 1024, pre-roll 1024 and extra artificial delay of 200 samples. The first coded audio data unit has a timestamp of $1-1024=-1023$ and is solely used for pre-roll. The second coded audio data unit has a timestamp of 1 and includes information within the coded audio data unit to trim the first 200 samples. Although the decoding result would normally consist of 1024 samples the first 200 samples are removed from the output and only 824 samples remain. The third coded audio data unit has a timestamp of 825 and also contains information within the coded audio data unit to trim the resulting audio output samples of length 1024 to the remaining 676 samples. Hence, information that the last $1024-676=348$ samples are invalid is stored within the coded audio data units.

In the presence of e.g. 1000 samples post-roll due to a different decoder mode the encoder output would change to four coded audio data units. The three first coded audio data units remain constant but another coded audio data is appended. When decoding, the operation for the first pre-roll Access Unit remains as in the example above. The decoding for the second Access Unit however has to take the extra delay for the alternative decoder mode into account. Three basic solutions are presented within this document to correctly handle the extra decoder delay.

1. the decoder delay is transmitted from the decoder to the system, which then delays all other parallel streams to conserve audio-video synchronization.
2. the decoder delay is transmitted from the decoder to the system, which can then remove the invalid samples at an audio-processing element, e.g. the rendering element.

3. the decoder delay is removed within the decoder. This results in a decompressed data unit with either a smaller size initially due to the removal of the extra delay or a delay of the data output until the signaled number of post-roll coded data units are provided to the decoder. The latter method is recommended and assumed for the remainder of the document.

Either the decoder or the embedding system layer will discard the entire output provided by the decoder for any pre-roll and/or post-roll coded data units. For the coded audio data units with extra trim information included, either the decoder or the embedding layer, guided by the audio decoder with additional information, can remove samples. Three basic solutions exist to correctly handle the trimming:

1. the trimming information is transmitted from the decoder to the system, which for the initial trimming delays all other parallel streams to conserve audio-video synchronization. The trimming at the end is not applied.
2. the trimming information is transmitted from the decoder to the system along with the decompressed data units, which can then be applied to remove the invalid samples at an audio-processing element, e.g. the rendering element.
3. the trimming information is applied within the decoder and invalid samples are removed from the beginning or end of a decompressed data unit before it is provided to the system. This results in a decompressed data units with a shorter duration than the common frame duration. It is recommended for a system to assume a decoder that applies the trimming and the timestamps and duration within the system should therefore reflect the trimming to be applied.

For multi-rate decoder operations the resolution of the trimming operation should be related to the original sampling frequency, which is typically encoded as the higher-rate component. Several resolutions for the trimming operation are imaginable, e.g. a fixed resolution in microseconds, the lowest-rate sampling frequency, or the highest-rate sampling frequency. To match the original sampling frequency, it is an embodiment of the invention to provide the resolution of the trimming operation together with the trimming values as a custom resolution. Hence, the format of the trimming information could be represented as a syntax like the following:

```
typedef struct trim {
    unsigned int resolution;
    unsigned short remove_from_begin;
    unsigned short remove_from_end;
};
```

Note that the presented syntax is just an example of how trimming information could be contained within a coded audio data unit. Other modified variants are covered by the invention, assuming they allow the distinction between valid and invalid samples.

Although some aspects of the invention were described in the context of an apparatus, it is noted that these aspects also represent a description of the corresponding method, i.e., a block or device corresponds to a method step or a feature of a method step. Analogously, aspects described in the context of a method step also represent a description of a corresponding block or item or feature of a corresponding apparatus.

The encoded data according to the invention may be stored on a digital storage medium or may be transmitted on a transmission medium such as a wireless transmission medium or a wired transmission medium such as the Internet.

Depending on certain implementation requirements, embodiments of the invention may be implemented in hardware or in software. The implementation may be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed. Other embodiments of the invention comprise a data carrier having electronically readable control signals, which are capable of cooperating with a programmable computer system, such that one of the methods described herein is performed.

Further, embodiments of the invention may be implemented as a computer program product with a program code, the program code being operative for performing one of the methods when the computer program product runs on a computer. The program code may for example be stored on a machine readable carrier. Other embodiments comprise the computer program for performing one of the methods described herein, stored on a machine readable carrier.

A further embodiment of the invention is a data stream or a sequence of signals representing the computer program for performing one of the methods described herein. The data stream or the sequence of signals may for example be configured to be transferred via a data communication connection, for example via the Internet.

Yet a further embodiment comprises a processing means, for example a computer, or a programmable logic device, configured to or adapted to perform one of the methods described herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A method for providing information on validity of encoded audio signal data that encodes an audio signal, the encoded audio signal data including a series of frames, the method comprising:

providing information which describes an amount of data to be trimmed at a beginning of a frame, the information being provided to be handled by an audio decoder for the encoded audio signal; or providing information which describes an amount of data to be trimmed at an end of the frame, the information being provided to be handled by the audio decoder; or providing information which describes both the amount of data to be trimmed at the beginning and the end of the frame, the information being provided to be handled by the audio decoder; and providing information which describes whether the corresponding frame is a pre-roll Access Unit, or which describes whether the corresponding frame is a post-roll Access Unit, or which describes whether the corresponding frame is at least one of the pre-roll Access Unit and the post-roll Access Unit, the information causing a Systems layer including an interface with the audio decoder to provide at least one of the pre-roll Access Unit and the post-roll Access Unit to the audio decoder and to discard a corresponding output of the audio decoder after decoding; wherein the method is performed using a hardware apparatus, a computer, or a combination of a hardware apparatus and a computer.

2. The method according to claim 1, wherein the information on the validity of encoded audio signal data is put in an optional portion of the frame.

3. The method according to claim 1, wherein the information on the validity of encoded audio signal data is attached to the frames which are affected.

4. The method according to claim 1, wherein valid audio signal data originates from a stream-based application or a live application.

5. The method according to claim 1, further comprising:

determining at least one of an amount of pre-roll data and an amount of post-roll data.

6. The method according to claim 1, wherein the information on the validity of encoded audio signal data comprises time-variant data and time-invariant data.

7. An encoder for providing information on validity of encoded audio signal data that encodes an audio signal, the encoded audio signal data including a series of frames, wherein:

the encoder is configured to provide information which describes an amount of data to be trimmed at a beginning of a frame, the information being provided to be handled by an audio decoder for the encoded audio signal data; or to provide information which describes an amount of data to be trimmed at an end of the frame, the information being provided to be handled by the audio decoder; or to provide information which describes both the amount of data to be trimmed at the beginning and the end of the frame, the information being provided to be handled by the audio decoder;

the encoder is configured to provide information which describes whether the corresponding frame is a pre-roll Access Unit, or which describes whether the corresponding frame is a post-roll Access Unit, or which describes whether the corresponding frame is at least one of the pre-roll Access Unit and the post-roll Access Unit, the information causing a Systems layer including an interface with the audio decoder to provide at least one of the pre-roll Access Unit and the post-roll Access Unit to the audio decoder and to discard a corresponding output of the audio decoder after decoding; and wherein the encoder comprises a hardware implementation.

8. A method for receiving encoded data comprising information on the validity of encoded audio signal data that encodes an audio signal and for providing decoded audio signal output data, the method comprising:

receiving encoded data with either information which describes the amount of data to be trimmed at the beginning of a frame, or information which describes the amount of data to be trimmed at the end of the frame, or information which describes both the amount of data to be trimmed at the beginning and the end of the frame, and providing decoded audio signal output data which only comprises samples of data not marked as to be trimmed; or providing decoded audio signal output data which comprises all audio samples of the frame and information to the application which part of the data is valid;

wherein the method is performed using a hardware apparatus, a computer, or a combination of a hardware apparatus and a computer.

9. The method according to claim 8, further comprising:

determining at least one of an amount of pre-roll and an amount of post-roll and using at least one of frames belonging to the pre-roll and frames belonging to the post-roll to reconstruct the original signal.

10. The method according to claim 8, further comprising:

transmitting a decoder delay from a decoder to a system using the decoded output data; and delaying, by means of the system, other parallel streams to conserve audio-video synchronization.

11. The method according to claim 8, further comprising:

transmitting a decoder delay from a decoder to a system using the decoded output data; and removing, by means of the system, audio samples to be trimmed at an audio-processing element.

12. The method according to claim 8, further comprising:

removing a decoder delay within a decoder.

13. The method according to claim 8, wherein the frames comprise extra trim information and the method further comprises:

transmitting the trim information from a decoder to a system using the decoded output data;

delaying, by means of the system, other parallel streams.

14. The method according to claim 8, wherein the frames comprise extra trim information and the method further comprises:

transmitting the trim information along with the decoded frames from a decoder to a system using the decoded audio signal output data;

applying the trim information to remove samples to be trimmed at an audio-processing element.

15. The method according to claim 8, wherein the frames comprise extra trim information and the method further comprises:

applying the trim information within a decoder and removing samples to be trimmed from the beginning or end of a decoded frame to achieve a trimmed decoded frame; and providing the trimmed decoded frame to a system using the decoded audio signal output data.

16. A decoder for receiving encoded data comprising information on the validity of encoded audio signal data that encodes an audio signal and for providing decoded audio signal output data, the decoder comprising:

an input configured to receive encoded data with either information which describes the amount of data to be trimmed at the beginning of a frame, or information which describes the amount of data to be trimmed at the end of the frame, or which describes both the amount of data to be trimmed at the beginning and the end of the frame;

a decoding portion configured to provide decoded audio signal output data which only comprises samples not marked as to be trimmed, or to provide decoded audio signal output data which comprises all audio samples of the frame and information to the application which part of the data is valid; wherein the decoder comprises a hardware implementation.

17. A non-transitory computer readable medium including a computer program comprising a program code for performing, when running on a computer, a method for providing information on the validity of encoded audio signal data that encodes an audio signal, the encoded audio signal data including a series of coded frames, the method comprising:

providing information which describes an amount of data to be trimmed at a beginning of a frame, the information being provided to be handled by an audio decoder for the encoded audio signal data; or providing information which describes an amount of data to be trimmed at an end of the frame, the information being provided to be handled by the audio decoder; or providing information which describes both the amount of data to be trimmed at the beginning and the end of the frame, the information being provided to be handled by the audio decoder; and providing information which describes whether the corresponding frame is a pre-roll Access Unit, or which describes whether the corresponding frame is a post-roll Access Unit, or which describes whether the corresponding frame is at least one of the pre-roll Access Unit and the post-roll Access Unit, the information causing a Systems layer including an interface with the audio decoder to provide at least one of the pre-roll Access Unit and the post-roll Access Unit to the audio decoder and to discard a corresponding output of the audio decoder after decoding.

18. A non-transitory computer readable medium including a computer program comprising a program code for performing, when running on a computer, a method for receiving encoded data comprising information on the validity of encoded audio signal data that encodes an audio signal and for providing decoded audio signal output data, the method comprising:

receiving encoded data with either information which describes the amount of data to be trimmed at the beginning of a frame, or information which describes the amount of data to be trimmed at the end of the frame, or information which describes both the amount of data to be trimmed at the beginning and the end of the frame, and providing decoded audio signal output data which only comprises samples of data not marked as to be trimmed; or providing decoded audio signal output data which comprises all audio samples of the frame and information to the application which part of the data is valid.

19. The method according to claim 1, wherein post-decoder trimming is applied after all data of the pre-roll Access Unit or the post-roll Access Unit has been processed.

* * * * *